US007527465B2

(12) United States Patent
Toyoizumi et al.

(10) Patent No.: US 7,527,465 B2
(45) Date of Patent: May 5, 2009

(54) BOOK-BINDING APPARATUS USING ADHESIVE AGENT

(75) Inventors: Teruhiko Toyoizumi, Tachikawa (JP); Masahiko Fukushima, Fussa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 107 days.

(21) Appl. No.: 11/507,615

(22) Filed: Aug. 22, 2006

(65) Prior Publication Data

US 2007/0122256 A1 May 31, 2007

(30) Foreign Application Priority Data

Nov. 30, 2005 (JP) ..... 2005-345426

(51) Int. Cl.
*B42C 9/00* (2006.01)
*B65H 33/04* (2006.01)

(52) U.S. Cl. ..... 412/37; 412/33; 156/359; 118/693; 270/58.09

(58) Field of Classification Search ..... 412/1, 412/4, 6, 8, 11, 12, 14, 19, 33, 37, 41, 902; 270/58.04, 58.09; 156/350, 351, 359, 578, 156/908; 118/666, 667, 693; 700/299
See application file for complete search history.

(56) References Cited

U.S. PATENT DOCUMENTS 3,925,126 A * 12/1975 Leatherman et al. ..... 156/73.6
5,152,654 A * 10/1992 Luhman et al. ..... 412/37
6,093,279 A * 7/2000 Detterman et al. ..... 156/295
6,142,721 A * 11/2000 Marsh ..... 412/1
6,685,416 B2 * 2/2004 Itoh et al. ..... 412/37

FOREIGN PATENT DOCUMENTS

| | | |
|---|---|---|
| JP | 9-156249 | 6/1997 |
| JP | 2002-177847 | 6/2002 |
| JP | 2004-209746 | 7/2004 |
| JP | 2005-178187 | 7/2005 |

* cited by examiner

*Primary Examiner*—Dana Ross
*Assistant Examiner*—Pradeep C Battula
(74) *Attorney, Agent, or Firm*—Finnegan, Henderson, Farabow, Garrett & Dunner, L.L.P.

(57) ABSTRACT

A book-binding apparatus in which adhesive is used for binding a book includes a tank to store an adhesive which is heat-melted, a heater to heat the tank, a first temperature sensor mounted in the tank, a first controller to control the temperature based on a temperature detected by the first temperature sensor, wherein the first controller controls the heater so as to make the temperature of the adhesive in the tank to be a predetermined temperature, a second temperature sensor mounted adjacent to a top level of a melted adhesive, an adhesive transporting section to transport the adhesive to the tank, and a second temperature controller to control the adhesive transporting section to transport the adhesive to the tank based on a shape of a book, when the temperature detected by the second temperature sensor is equal to or lower than a set temperature.

17 Claims, 14 Drawing Sheets

BOOK-BINDING APPARATUS USING ADHESIVE AGENT

This application is based on Japanese Patent Application No. 2005-345426 filed on Nov. 30, 2005, in the Japanese Patent Office, the entire content of which is hereby incorporated by reference.

TECHNICAL FIELD

The present invention relates to a book-binding apparatus using adhesive agent in which the replenishing amount of the adhesive agent to be coated on a spine of the stacked sheets is controlled.

BACKGROUND

In the book-binding apparatus using the adhesive agent, a method of book-binding is known in which a liquid adhesive agent is used. A solid member, being a hot-melt material, to be melted as an adhesive agent is becoming more widely used.

For book-binding, the hot-melt solid adhesive agent is melted at a predetermined temperature, and which is then applied on the stacked bundle of sheets. In this case, temperature control of melting point of the solid adhesive agent is extremely important.

To replenish the adhesive agent into the adhesive agent tank, a replenishing section is widely used in which a predetermined amount of the adhesive agent is supplied, independently of the used amount of the adhesive agent. However, if a large predetermined amount is established by the operator, temperature for melting the adhesive agent in the tank largely drops so that the adhesive agent does not melt at its required temperature, and thereby, an abnormal odor is generated from the adhesive agent. Further, if a small predetermined amount is established, the number of times of the replenishment increases, which results in short durability of the parts incorporated in the apparatus, as well as results in an increase of inherent operating sounds.

In order to overcome these problems, in Patent Document 1, after the adhesive agent is coated on the spine of the stacked bundle of sheets, the adhesive agent is required to be dried in a short time. That is, a dryer section which includes a heater, a blower and a duct, and an adhesive section which includes an adhesive roller to apply the adhesive agent on the spine, and an adhesive tank, are arranged in this order. While a cramp section secures the stacked bundle of sheets, a moving section of the sheet securing section drives a sheet securing section from the cramp section, and further drives back and forth to the dryer section and the adhesive section. A control section controls the moving section of the sheet securing section and the dryer section while the reciprocating movement of the sheet securing section so that the coating of the adhesive agent and drying can be effectively controlled.

Patent Document 1 shows that via forcing the adhered section to be dried in a short time, generation of abnormal odor is controlled.

Patent Document 2 shows a book-binding apparatus in which an adhesive agent pool and an integral roller moves under the stacked bundle of sheets to apply the adhesive agent onto the spine of the stacked bundle of sheets, and by detecting thickness of the stacked bundle of sheets, during the reciprocating movement of the adhesive agent pool, the rotation of the roller is differently controlled for effective bonding.

Further, an electromagnetic induction coil is used for the heat source to melt the adhesive agent, and a thermo-couple method is used for the temperature control section. In this method, when the adhesive agent is reduced due to consumption, the top level of the adhesive agent is lowered than the position of the thermo couple, then the detected temperature becomes lower than the predetermined temperature, and an appropriate signal is sent to the control section. The control section receives this signal and operates an adhesive agent replenishing unit to supply the adhesive agent.

In Patent Document 3, a pasting bookmaking apparatus is described, which includes: an adhesive agent container for housing the adhesive agent, featuring an open section, a container loading section for loading the adhesive agent container at a predetermined position, a supplying tube for sending the adhesive agent ejected from the open section, an adhesive agent discharging section connected to the supplying tube for discharging the adhesive agent from a nozzle top, a temperature sensor and a heating section placed adjacent to the adhesive agent container, and a control section wherein when the temperature sensor detects that the temperature is lower than a predetermined temperature, the control section activates a power source of the heating section, and makes the heating section to increase the temperature of the adhesive agent container.

In a bookbinding apparatus of Patent Document 4, the back face of the paper bundle is coated with the adhesive agent by integrally reciprocating an adhesive reservoir and a roller on the lower side of the paper bundle, an adhesive feeding unit provided from a standby position of the adhesive reservoir to a facing position by pinching the paper bundle, is further provided. The adhesive feeding unit is composed of a storing section for storing a particulate adhesive agent, included carrying paths for the particulate adhesive agent provided below and in a declining slope from the storing section, and a feeding hole to allow the particulate adhesive to pass through the inclined carrying paths. The adhesive feeding unit feeds a specified amount of the particulate adhesive agent into the adhesive reservoir at appropriate timing when the adhesive reservoir is moved, and which exists near the feeding hole.

[Patent Document 1] Unexamined Japanese Patent Application Publication No. 9-156249

[Patent Document 2] Unexamined Japanese Patent Application Publication No. 2005-178187

[Patent Document 3] Unexamined Japanese Patent Application Publication No. 2002-177847

[Patent Document 4] Unexamined Japanese Patent Application Publication No. 2004-209746

SUMMARY

However, in the above Patent Documents, any countermeasures of the problem which happens when a predetermined amount of the adhesive agent is replenished, is not described, and the problem is not overcome.

An object of the present invention is to provide a book-binding apparatus in which a control section is used for keeping the amount of adhesive agent at a constant value in an adhesive agent tank, based on the shape of a book to be bundled, such as the thickness of the book. As the shape of the book, the thickness is more preferable than the number of pages or the quality of paper.

The object of the present invention is attained by the structures described below.

[Structure 1] A book-binding apparatus using adhesive agent, including:

an adhesive agent tank to store a heat melting adhesive agent;

a heating section to heat the adhesive agent tank;

a first temperature sensor mounted in the adhesive agent tank;

a first control section to control the temperature based on a temperature detection signal sent from the first temperature sensor, wherein the first control section controls the heating section so as to make the temperature of the adhesive agent in the tank to become a predetermined temperature;

a second temperature sensor mounted at a position adjacent to a top level of the melted adhesive agent;

an adhesive agent transporting section to transport the adhesive agent to the adhesive agent tank; and a second control section to control the adhesive agent transporting section to transport the adhesive agent to the adhesive agent tank based on a shape of a book to be bound, when the temperature detected by the second temperature sensor is equal to or lower than a set temperature.

[Structure 2] The book-binding apparatus, including:

an adhesive agent tank to store a heat melting adhesive agent;

a temperature sensor mounted at a position adjacent to a top level of a melted adhesive agent;

an adhesive agent transporting section to transport a adhesive agent to the adhesive agent tank; and a control section to control the adhesive agent transporting section to transport the adhesive agent to the adhesive agent tank based on a shape of a book, when the temperature detected by the temperature sensor is equal to or lower than a set temperature.

BRIEF DESCRIPTION OF THE DRAWINGS

Embodiment will now be described, by way of example only, with reference to the accompanying drawings, which are meant to be exemplary, not limiting, and wherein like elements are numbered alike in the several figures, in which.

DESCRIPTION OF THE PREFERRED EMBODIMENT

The embodiments of the present invention will now be described below, however the inventions are not limited by these embodiments.

Figure 1:
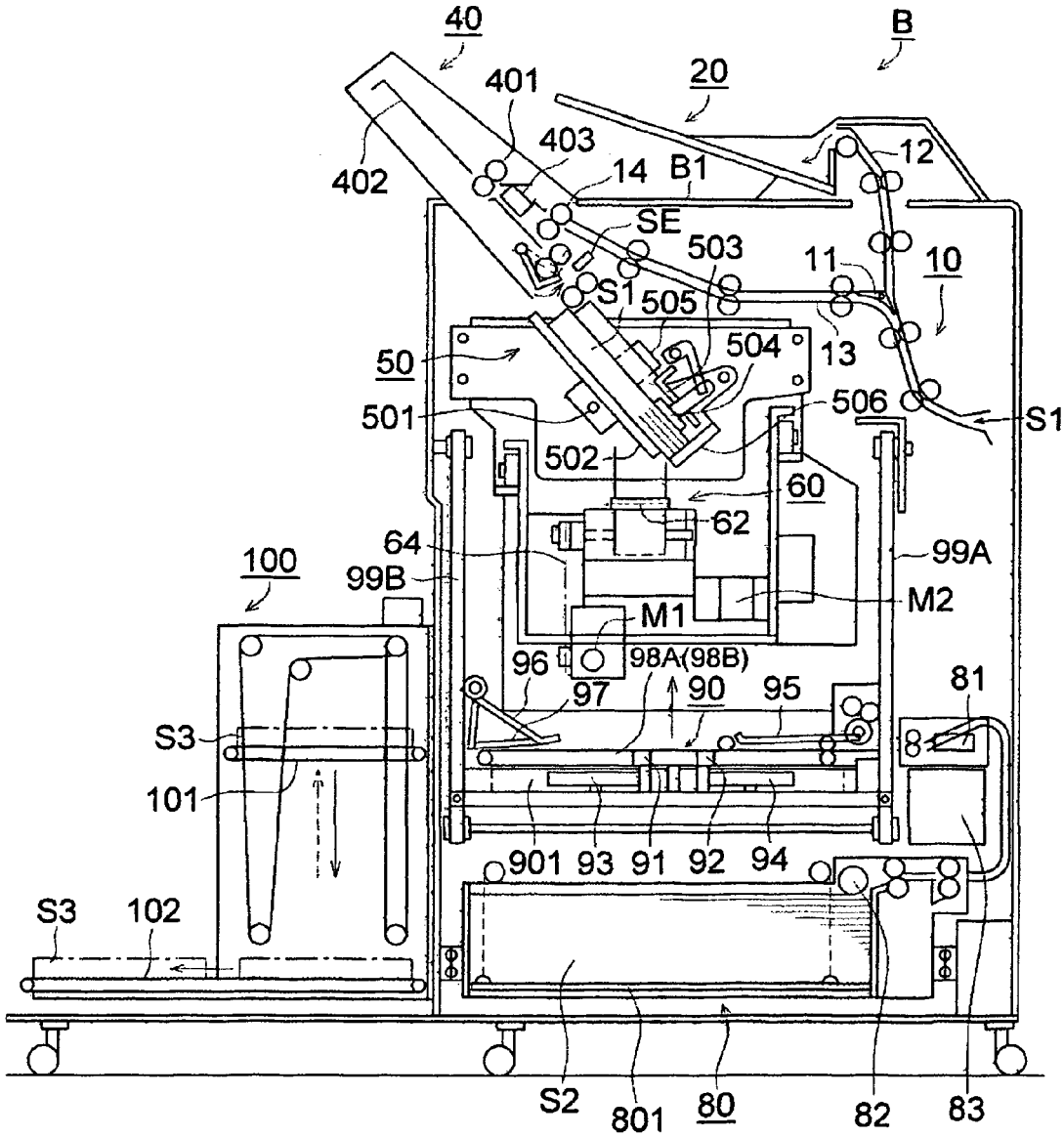
FIG. 1 is a cross-sectional view of the book-binding apparatus relating to the embodiment of the present invention.

FIG. 1 is a total view of the book-binding apparatus relating to the embodiments of the present invention.

(Book-Binging Apparatus)

Book-binding apparatus B includes conveyance section 10 for conveying sheets S1 ejected from an image forming apparatus (which is not illustrated) onto ejection tray 20 or sheet flipping section 40, stacking section 50 to stack and bundle sheet S1 which is fed individually from sheet flipping section 40, adhesive agent coating section to, cover housing section 80 to store covers S2, cover supporting unit 90 for supporting the cover, and book ejecting section 100 for storing the completed books, whose cover and the sheets have been joined.

Sheet S1, ejected from an image forming apparatus, is further ejected onto ejection tray 20 through ejection route 12 by path changing gate 11 provided on conveyance section 10, or sheet S1 is conveyed to sheet flipping section 40 which allows sheet S1 to go and return. In addition, in a mode except for book-binding, sheet S1 is ejected onto ejection tray 20.

After sheet S1 is conveyed to sheet flipping section 40 through conveyance route 13, sheet S1 is switch-backed to be conveyed to stacking section 50. At stacking section 50, a predetermined volume of sheets S1 are to be stacked, that is, after the predetermined number of sheets S1 are stacked on stacking section 50, stacking section 50 nips stacked sheets S1 and rotates them to perpendicularly support bundled sheets S1.

Adhesive agent is coated by coating section 60 onto the spine (which is supported on plate 506 in FIG. 1) of sheets S1, which is perpendicularly supported by stacking section 50.

Cover S2 is adhered onto newly bound sheets S1 so that book S3 is formed, and which is ejected onto book ejecting section 100.

In the following explanation, S1 represents the sheet to be structured as a book, S2 represents the cover sheet of the book, and S3 represents a formed book, including sheets S1 and cover S2.

In addition, the control described above is conducted by a control section (which is not illustrated) in the book-binding apparatus, which is also conducted in the following explanation.

Each section of the book-binding apparatus will be detailed below, while referring to FIG. 1.

Sheet S1 is conveyed through conveyance route 13, and further conveyed by paired ejection rollers 14 and paired swinging pressure rollers 401 to climb slanted reversing plate 402, after which, sheet S1 is conveyed downward by the reverse rotation of paired swinging pressure rollers 401, and is dropped onto stacking section 50.

Slanted sheets S1 are supported in stacking section 50 by a sheet supporting section composed of supporting plate 502 and receiving plate 506.

After sequential sheets S1, ejected from the image forming apparatus, are stacked in the proper order in stacking section 50, sheets S1 are formed as a set of sheets. The number of sheets S1 to be formed as a set have been determined by the total number of the document counted by an automatic document feeding device provided in the image forming apparatus, the number of the documents obtained from document image information via a personal computer, and the number of the documents previously inputted by an operator.

Numeral 504 represents a holding member to hold stacked sheets S1, wherein every time when sheet S1 is supplied to stacking section 50, holding member 504 holds sheet S1 respectively, by touching and separating from sheet S1. Numeral 505 represents a plate to jog the set of sheets S1.

After the predetermined number of sheets S1 are stacked on stacking section 50, holding plate 503 moves to nip and support the stacked set of sheets S1.

Next, stacking section 50 rotates around axis 501 so that the stacked set of sheets S1 is changed to a vertical position from the slanted position.

(Adhesive Agent Coating Procedure)

Figure 2:
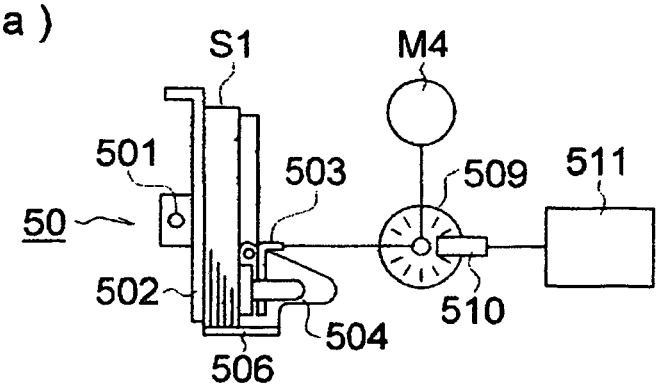
FIG. 2(*a*)-(*d*) show coating procedures of the adhesive agent.
Figure 2:
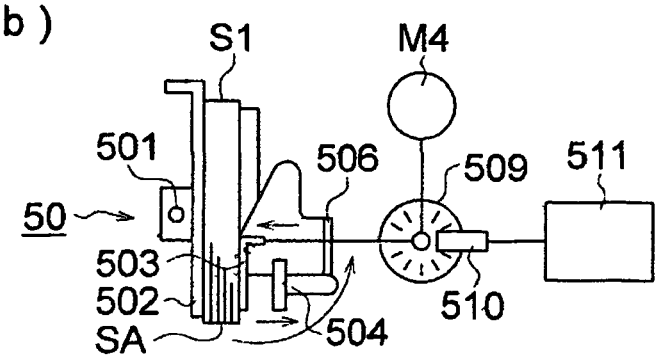
Figure 2:
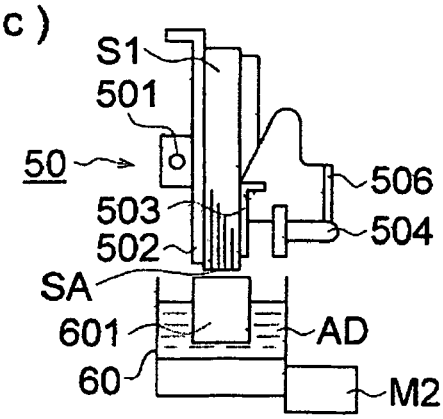
Figure 2:
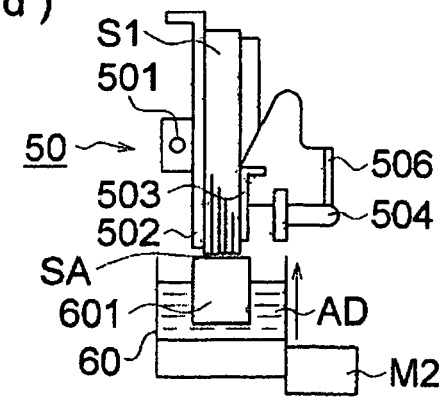

FIG. 2 shows the procedure for coating the adhesive agent, while the stacked set of sheets S1 is perpendicularly supported on stacking section 50.

Before explaining the coating procedure, the procedure for supporting the sheets by holding plate 503 will be detailed referring to FIG. 2(*a*).

Holding plate 503, activated by motor M4, presses the stacked set of sheets S1, and when driving torque of the press action reaches a predetermined value, holding plate 503 is stopped, and the stacked set of sheets S1 is strongly sandwiched between supporting plate 502 and holding plate 503. The position where holding plate 503 stops is detected by encoder 509, and the position is memorized in a memory device of position detecting section 511.

While the stacked set of sheets S1 is supported, receiving plate 506 rotates 90° to the position as shown in FIG. 2(*b*).

In FIG. 2(*c*), spine SA (which is the surface formed of edges of stacked set of sheets S1, and to be coated with an adhesive agent) of the stacked set of sheets S1 is not in contact with adhesive agent coating roller 601.

Next, in FIG. 2(*d*), coating section 60, storing melted hot-melt adhesive agent AD is driven upward by motor M2, after which adhesive agent coating roller 601 comes into contact with spine SA, and moves in the direction perpendicular to the surface of FIG. 2(*d*), and thereby spine SA is coated with hot-melted adhesive agent AD.

(Coating Section)

Figure 3:
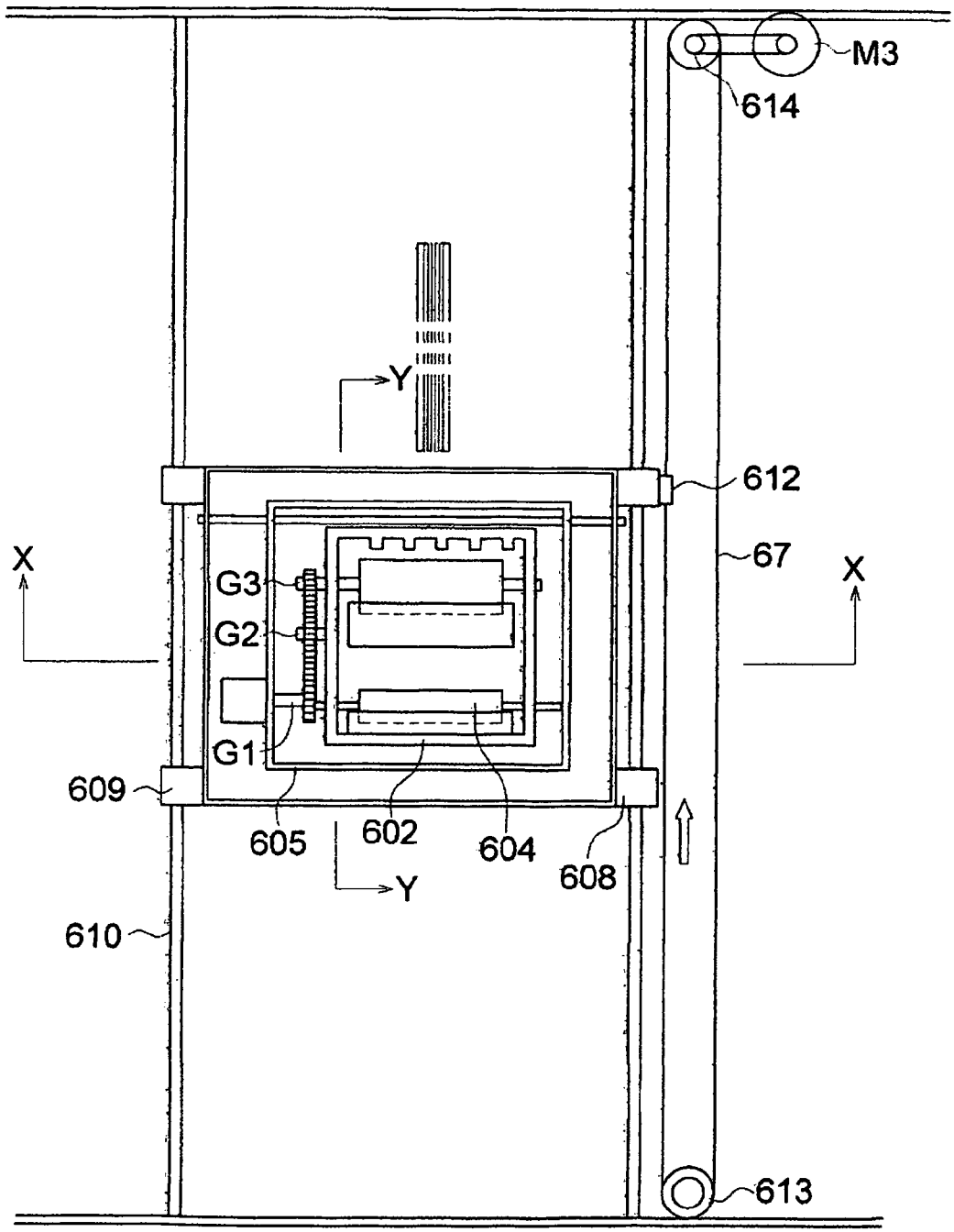
FIG. 3 is a plane view of the coating section, which is viewed from the top.
Figure 4:
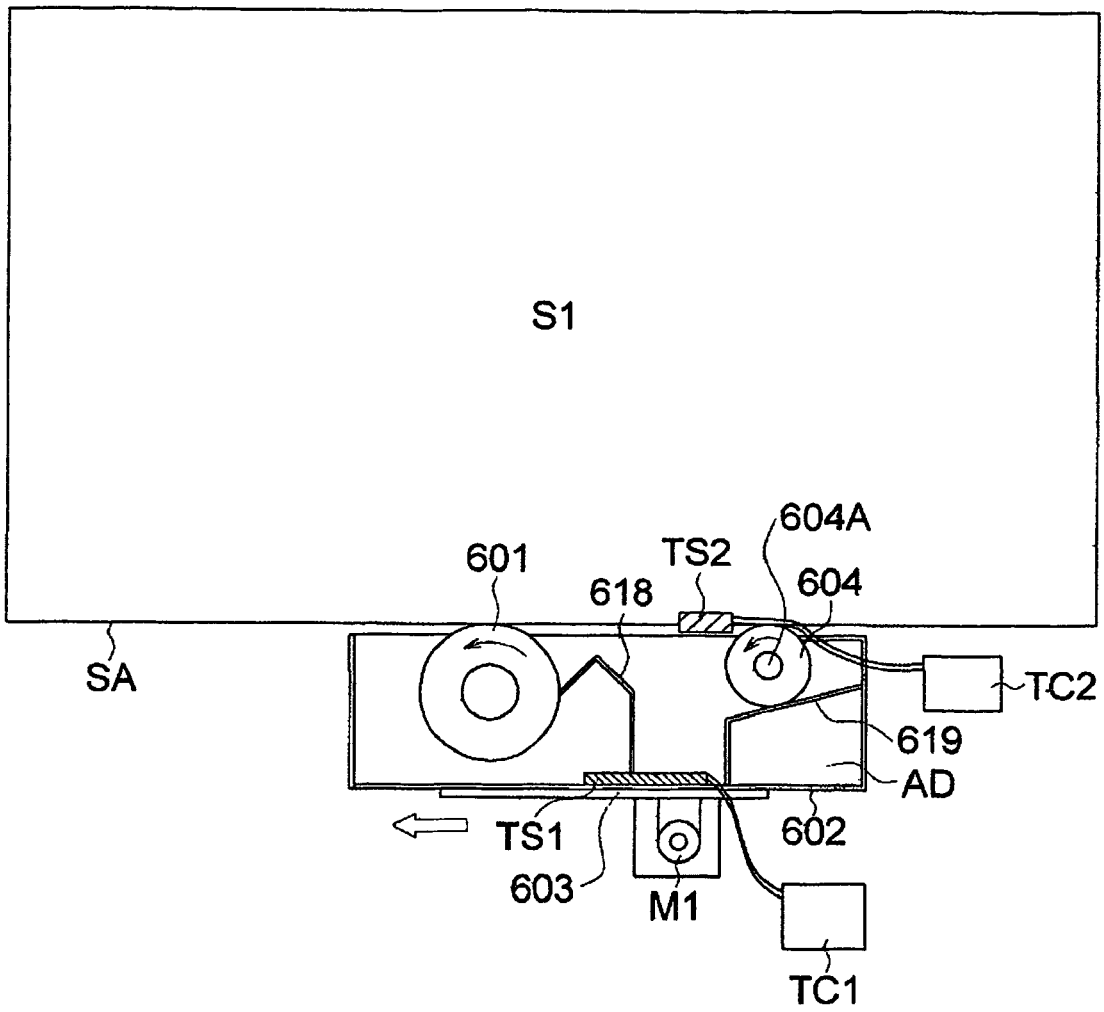
FIG. 4 is a cross-sectional view taken along line Y-Y of FIG. 3.
Figure 5:
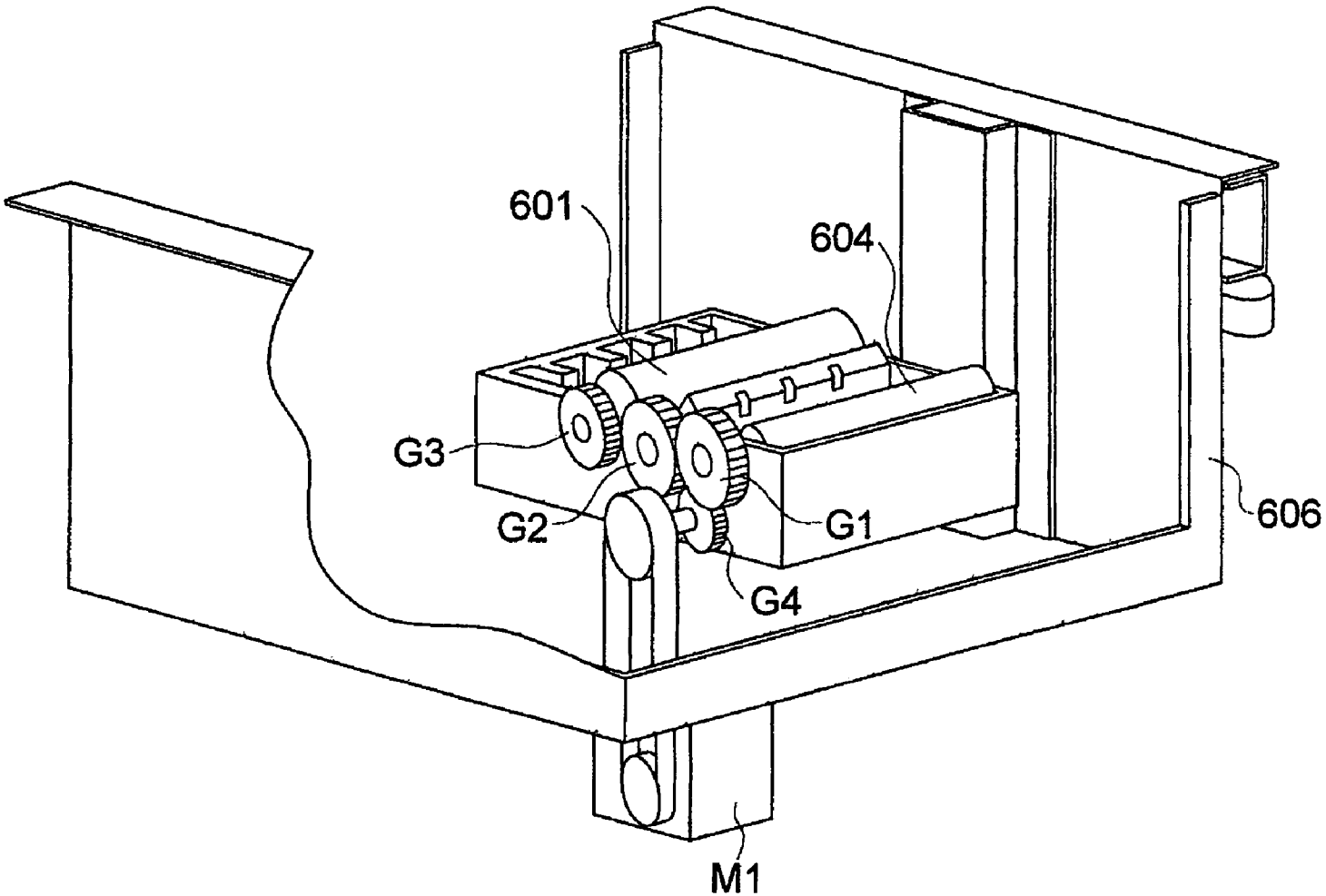
FIG. 5 is a perspective view of the coating section.
Figure 6:
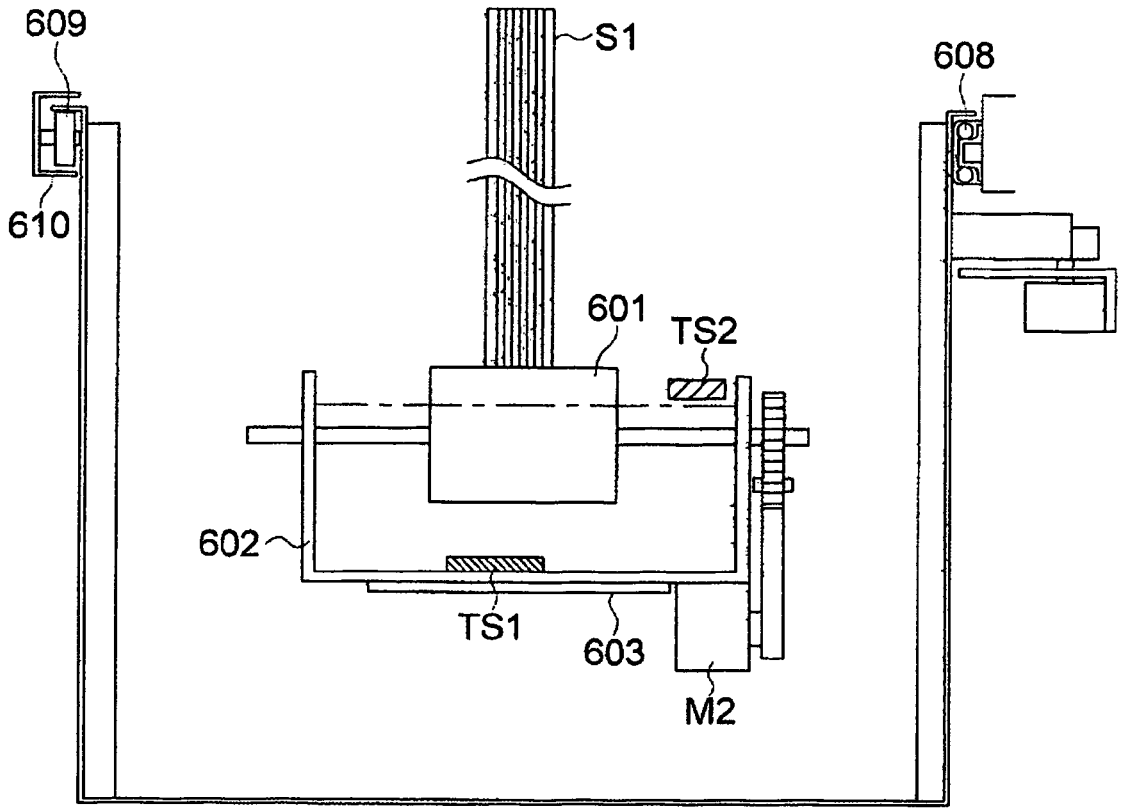
FIG. 6 is a cross-sectional view taken along line X-X of FIG. 3.

FIG. 3 is a plane view of coating section 60 which is viewed from the top, FIG. 4 is a cross-sectional view taken along line Y-Y of FIG. 3, and FIG. 5 is a perspective view of coating section 60. FIG. 6 is a cross-sectional view taken along line X-X of FIG. 3, in which first temperature sensor TS1 and second temperature sensor TS2 are provided.

In FIG. 3, endless belt 67 allows coating section 60 to move, since connecting member 612 is fixed to a point of endless belt 67, and coating section 60 connected to sliding section 608 moves along slide rail 610.

Belt 67 is trained about pulleys 613 and 614, which are provided near the extreme ends of slide rail 610, and pulley 614 is driven by belt drive motor M3.

In FIG. 4, numeral 604 represents an adhesive agent leveling roller to even out hot-melt adhesive agent AD supplied onto book spine SA, and gear G1 (shown in FIG. 5) is mounted on rotation shaft 604A.

Numeral 618 represents a regulating plate to control the amount of hot-melt adhesive agent AD which is supplied onto adhesive agent coating roller 601, and roller 618 is mounted at a predetermined clearance from roller 601. Numeral 619 represents a cleaning plate to remove any remaining hot-melt adhesive agent AD on adhesive agent leveling roller 604, and cleaning plate 619 comes into contact with adhesive agent leveling roller 604 at a predetermined pressure.

Rollers 601 and 604 are driven by motor M1, and their rotation is set to be the same as the traveling direction of coating section 60.

Numeral 602 represents a tank to store hot-melt adhesive agent AD in the melted state. Heater 603 to heat tank 602 is placed below tank 602.

In FIG. 5, gear G4 is rotated by motor M1 through two timing pulleys and a timing belt. Idler gear G2 is rotated by gear G4. Gear G1, mounted on the shaft of adhesive leveling roller 604, is rotated by gear G4. Gear G3, mounted on the shaft of adhesive agent coating roller 601, is rotated by idler gear G2. Accordingly adhesive agent coating roller 601 and adhesive leveling roller 604 are rotated by motor M1.

In FIG. 6, first temperature sensor TS1 is provided at the bottom of tank 602. First temperature control section TC1 shown in FIG. 4 controls the temperature of adhesive agent stored in tank 602 by activating or de-activating the power supply of heater 603 based on the electrical signals from first temperature sensor TS1.

Further in FIG. 6, second temperature sensor TS2 is provided at the position adjacent to the top level of the melted adhesive agent. Second temperature control section TC2 shown in FIG. 4 controls the temperature of adhesive agent, based on electrical signals from second temperature sensor TS2.

As adhesive agent AD is consumed, the top level of adhesive agent AD drops, and a distance is created between the top level of adhesive agent AD and second temperature sensor TS2. Accordingly, when the temperature detected by sensor TS2 drops, and reaches a predetermined temperature, adhesive agent AD is replenished to tank 602.

Figure 7:
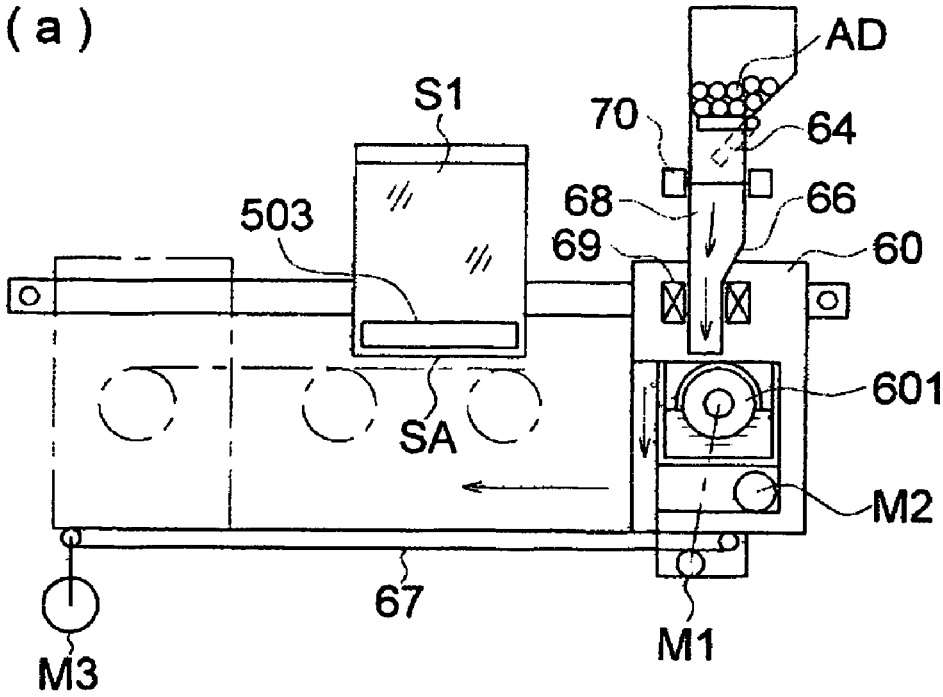
FIG. 7(*a*)-(*b*) show the adhesive agent replenishing section.
Figure 7:
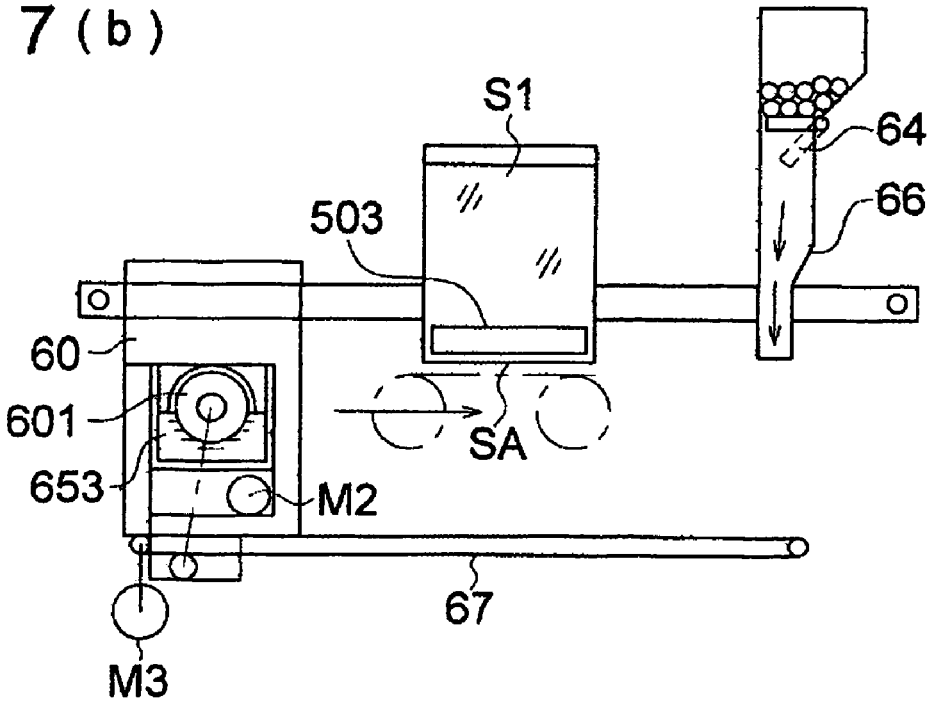

In FIG. 7(*a*), at the start of the book binding operation, coating section 60 is on standby at the right-most position (being the initial position) also known as the home position. When the book-binding operation starts, coating section 60 is conveyed by belt 67 (being a second moving section) activated by motor M3, toward the left away from the home position. Coating section 60 is conveyed based on a signal that sheet sensor SE, located just downstream of reversing plate 402 (see FIG. 1), detects the passage of the top of sheet S1 which is the last one of stacked sheets S1 on stacking section 50. While coating section 60 is conveyed toward the left, adhesive agent coating roller 601 is not in contact with spine SA of stacked sheets S1.

Next, while coating section 60 is conveyed from the left position toward the right position [see FIG. 7(*b*)], coating roller 601 is elevated by motor M2 to come into contact with spine SA of sheets S1, and thereby coats adhesive agent AD on spine SA. In addition, at the start of the agent coating operation in FIG. 7(*a*), when stacked sheets S1 are vertically positioned to be coated, as well as when the conveyance of the cover sheet which was cut by cutter 81 is terminated, the adhesive coating operation starts.

By the control of the timing control mentioned above, the working of each section is continuously conducted so that the efficient book-binding is performed. After coating section 60 returns to the home position, cover S2 is adhered.

(Replenishment of the Adhesive Agent)

In FIG. 7(*a*), numeral 66 represents a chute, numeral 64 represents a valve to replenish a predetermined volume of the adhesive agent. Further, numeral 68 represents a conveyance section which conveys the solid pieces of adhesive agent to tank 602, vibrator 69 is provided midstream of the conveyance path to prevent the solid pieces of adhesive agent from clogging in chute 66.

Numeral 70, serves as a counter to count the number of solid pieces of the adhesive agent, is an optical sensor including a light emitting section and a light receiving section. When the solid piece of the adhesive agent passes counter 70, the solid piece interrupts the light ray between the light emitting section and the light receiving section, whereby the number of pieces is counted based on the signals received by the light receiving section. When the signal for replenishing the adhesive agent is transmitted from the control section of the book-binding apparatus, valve 64 is opened, and the some pieces of the adhesive agent pass counter 70. Signals representing the counted number are transmitted to the control section of the book-binding apparatus so that at least the necessary number of pieces of adhesive agent are replenished into tank 602, after which valve 64 is closed by the signal from the control section.

Instead of employing the counter, it is also possible to employ the method wherein after the predetermined mass of the adhesive agent is measured, the adhesive agent is replenished in bulk, being a batch processing.

Further, it is also possible to employ the method wherein after the predetermined volume is detected by a bucket to scoop the agents, the adhesive agent is replenished together.

(Measuring the Thickness of the Stacked Sheets to be Bound)

As initially described referring to FIG. 24*a*), stacked sheets S1 are supported between supporting plate 502 and holding plate 503, and the position of holding plate 503 is detected by encoder 509, and thereby the thickness of the stacked sheets S1 is counted based on the memory device of position detecting section 511.

(Joining Operation)

The joining operation of stacked sheets S1 and cover S2 will be detailed while referring to FIGS. 8-12.

Figure 8:
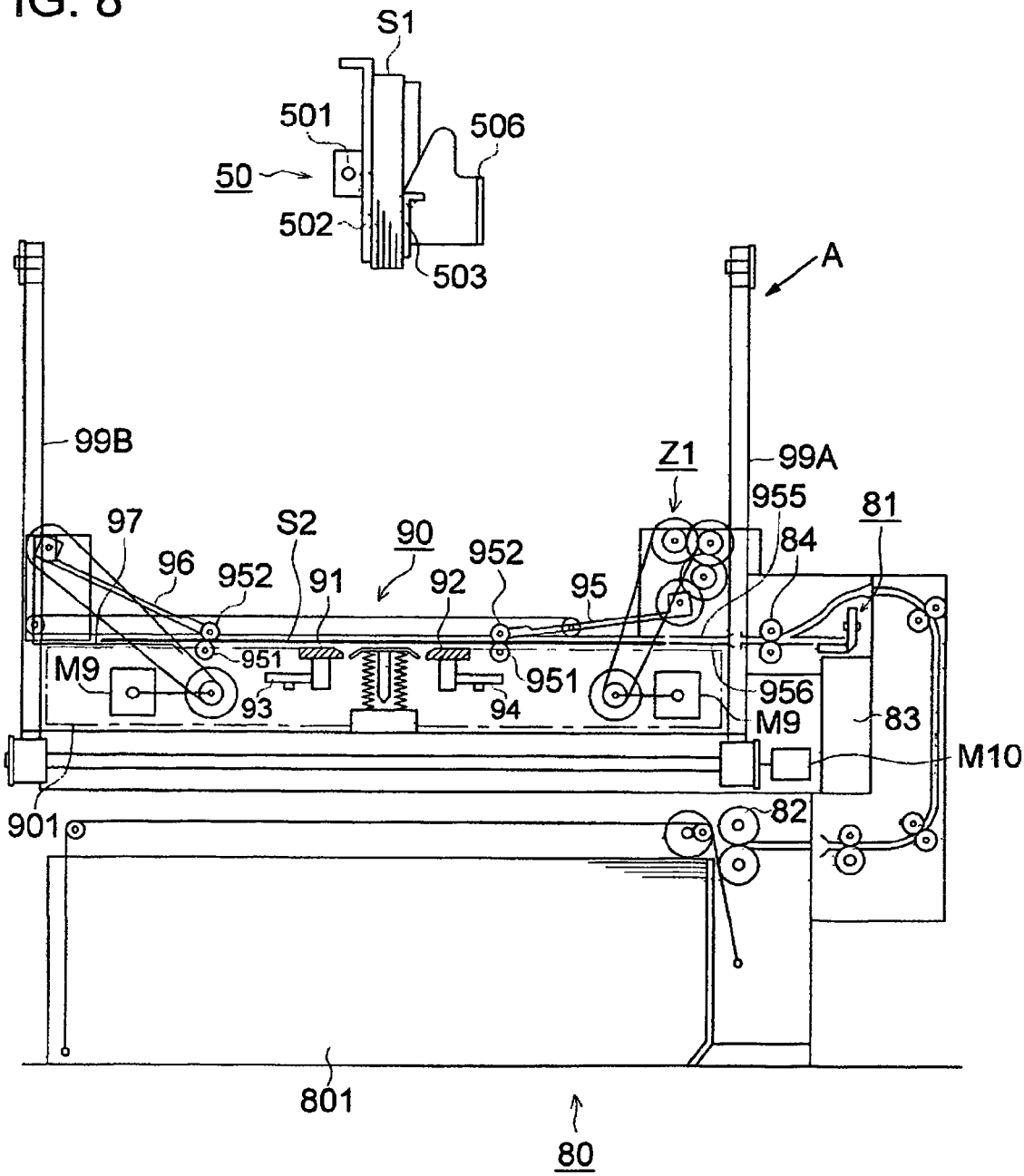
FIG. 8 is a cross-sectional view of a cover housing section and a cover supporting unit.
Figure 9:
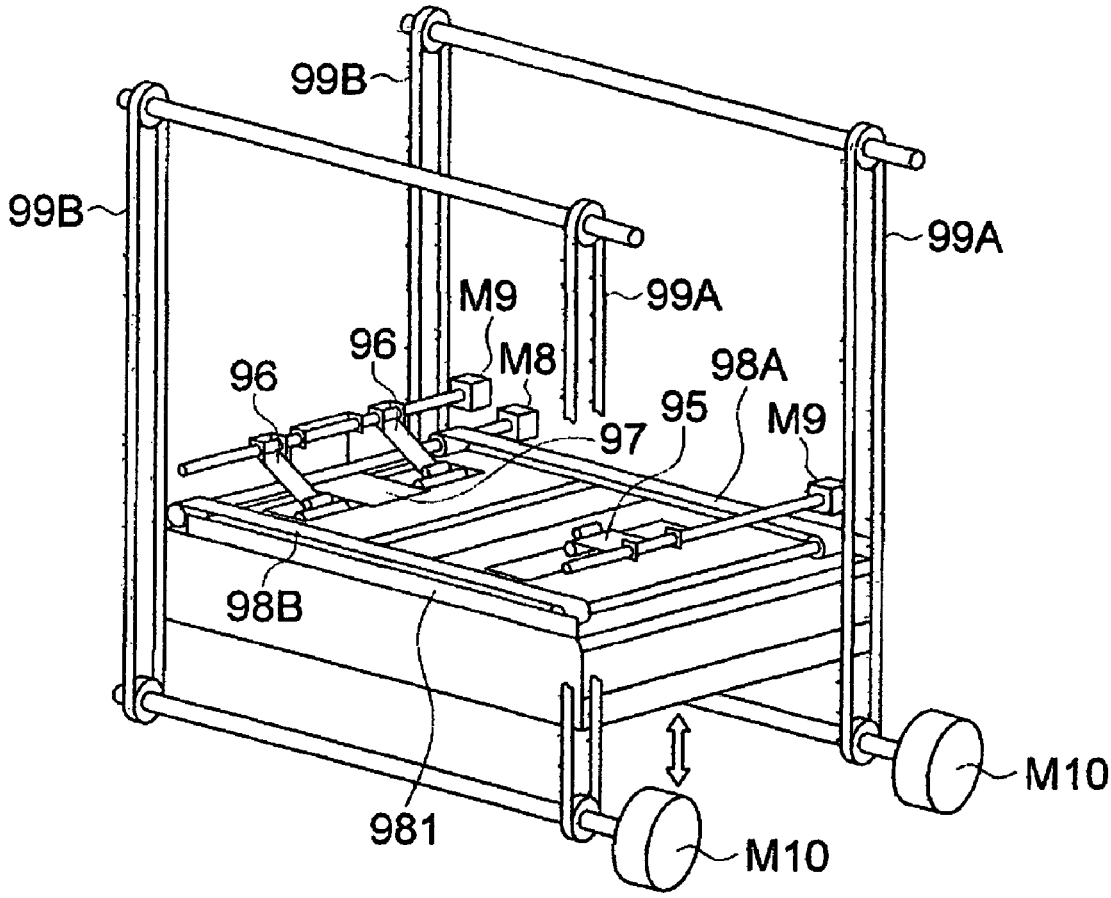
FIG. 9 is across-sectional view of the cover supporting unit which is viewed from direction A in FIG. 8.

FIG. 8 is a cross-sectional view of cover housing section 80 to store cover S2 and cover supporting unit 90, while FIG. 9 is across-sectional view of cover supporting unit 90 which is viewed from direction A in FIG. 8.

As shown in FIG. 8, cover S2, which is stored in cover sheet tray 801 of cover housing section 80 provided at the bottom of the book-binding apparatus, is picked up by paired supply-conveyance rollers 82, and is aligned in cover supporting unit 90, after which cover S2 is switched-back to cutter 81 as a cover cutting section, whereby cover S2 is cut the adequate length for stacked sheets S8. Next, cover S2 is conveyed by paired conveyance rollers 84, and horizontally placed in cover supporting section 901 which is shown by dashed lines in FIG. 8. Cover supporting section 901 is structured of plural members, such as pressuring members 91 and 92, as well as cams 93 and 94 for driving pressuring members 91 and 92.

In addition, cutter 81 cuts cover S2 to the proper length, based on information of the size of cover S2, information of the size of sheet S1, and information of the thickness of stacked sheets S1 stored in position detecting section 511. Trimmings from cover S2 fall into box 83.

Cover S2, which was cut to a predetermined length, is conveyed by upper guide plate 955 and lower guide plate 956, each keeping the distance of nearly 5 mm. Cover S2 is conveyed by paired cover conveyance roller 951 and driven roller 952, the latter of which is provided on the top of cover holding members 95 and 96. When cover S2 arrives at a predetermined position, which is determined based on information of the size of cover S2 and information of the thickness of stacked sheets S1, cover S2 is controlled to be stopped. In addition, cover holding member 97 is positioned under cover S2 to hold up cover S2 from beneath.

Figure 10:
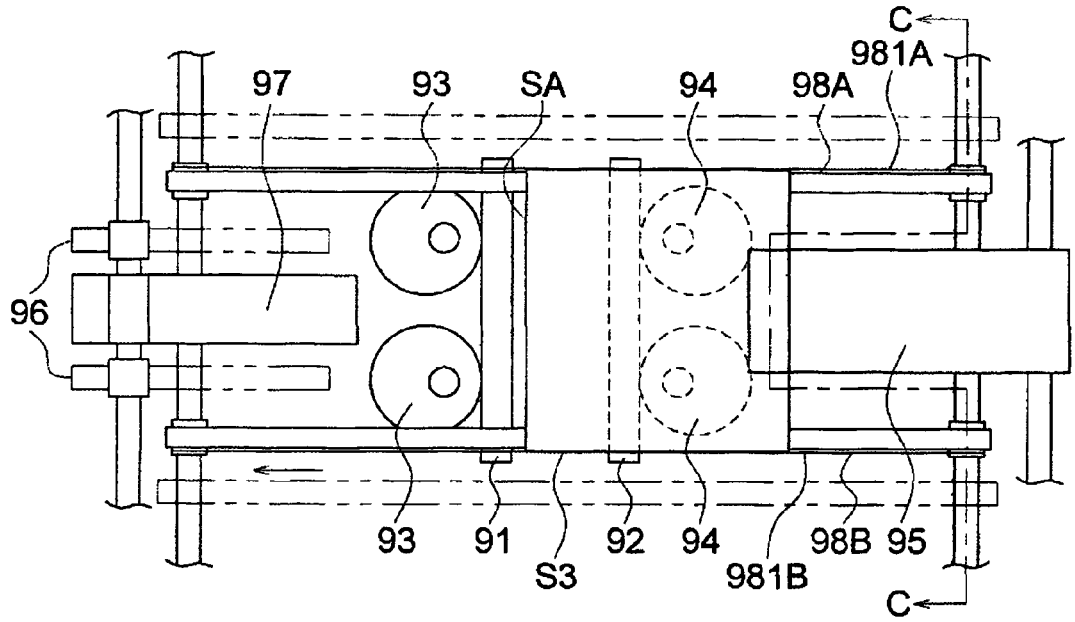
FIG. 10(*a*) is a top view of the cover supporting section, while FIG. 10(*b*) is a cross-sectional view taken along line C-C of FIG. 10(*a*)
Figure 10:
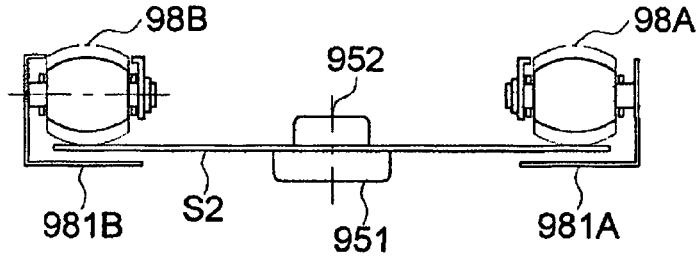

FIG. 10(*a*) is a top view of cover supporting section 901, while FIG. 10(*b*) is a cross-sectional view taken along line C-C of FIG. 10(*a*).

Belts 98A and 98B correct any miss alignment of conveyed cover S2, and also convey bound book S3 to book ejecting section 100 (see FIG. 1).

As a section to align cover S2, alignment members 981A and 982B are provided to align both edges of cover S2 perpendicular to the conveyance direction of cover S2. Belts 98A and 98B are entrained on convex rollers which are mounted on alignment members 981A and 981B, respectively. Alignment members 981A and 981B correct any miss alignment of each conveyed cover S2. Further, when cover supporting member 901, which is detailed later, goes up, alignment members 981A and 981B, as well as belts 98A and 98B are retracted to the positions shown by double-dashed lines in FIG. 10(*a*).

Figure 11:
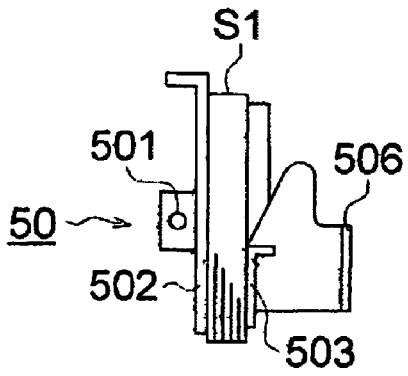
FIG. 11(*a*)-(*c*) show the procedures to attach the cover on the stacked bundle of sheets.
Figure 11:
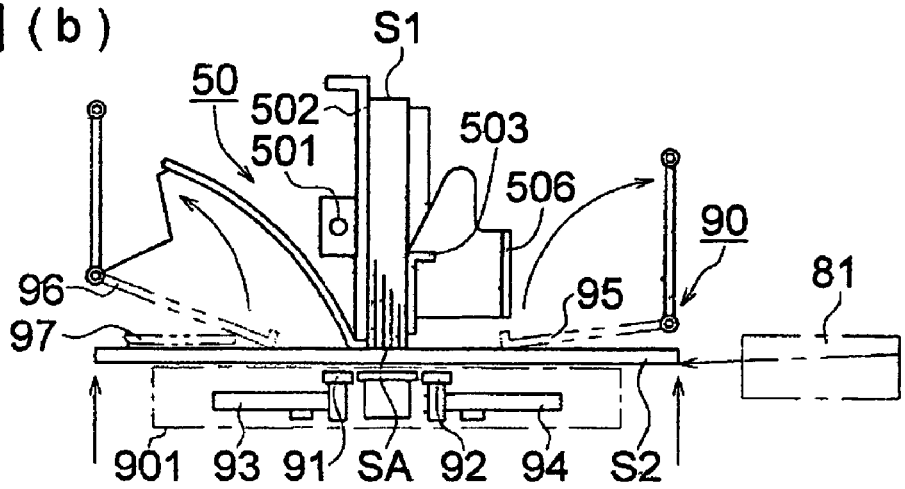
Figure 11:
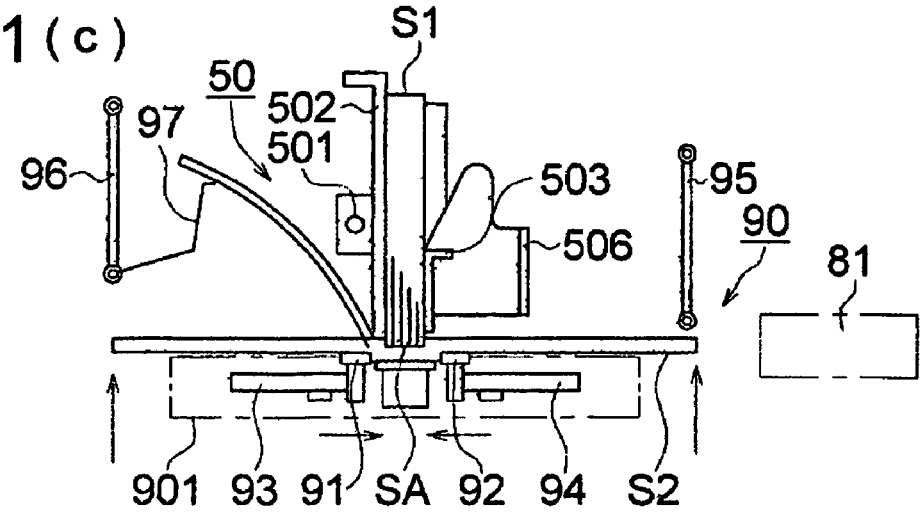

In FIG. 11, cover S2, while pressed by pressing members 95 and 96, goes up with cover supporting member 901, conveyed by belts 99A and 99B (being first conveyance sections, see FIG. 9) driven by motors M10.

FIG. 11(*a*) shows the condition in that hot-melt adhesive agent AD has been applied. In this condition, cover supporting section 901 supports cover S2 at a beneath position, which is away from the spine of bundled stacked sheets S1.

When cover supporting section 901 went up, cover holding members 95 and 96 hold cover S2 from above to keep cover S2 in a flat condition. Cover S2 goes up and comes into contact with spine SA of stacked sheets S1, while cover holding members 95, 96 and 97 are released from holding by a motor (which is not illustrated), and whose final positions are shown in FIG. 11(*b*). In this case, cover S2 has been pushed up from beneath by cover holding member 97, which is positioned under cover S2.

Cover supporting section 901 further goes up about several mm higher than the position shown in FIG. 11(*b*). The position gone up several mm is shown in FIG. 11(*c*). After cover supporting section 901 goes up, pressing members 91 and 92 press cover S2 from side to side to generate creases at a border of the spine cover and the front cover, as well as at the border of the spine cover and the back cover, after which cover S2 is contacted to the adhesive agent applied on spine SA of sheets S1 to produce book S3. Pressuring members 91 and 92 press against cover S2 for 5 seconds with the pressure strength of about 200 Nf.

In addition, pressing members 91 and 92 are horizontally moved by cams 93 and 94 (see FIG. 10) driven by a motor (which is not illustrated). It is also possible to structure racks on pressing members 91 and 92, and the rotation of pinion gears engaging with the racks drives pressing member 91 and 92.

Figure 12:
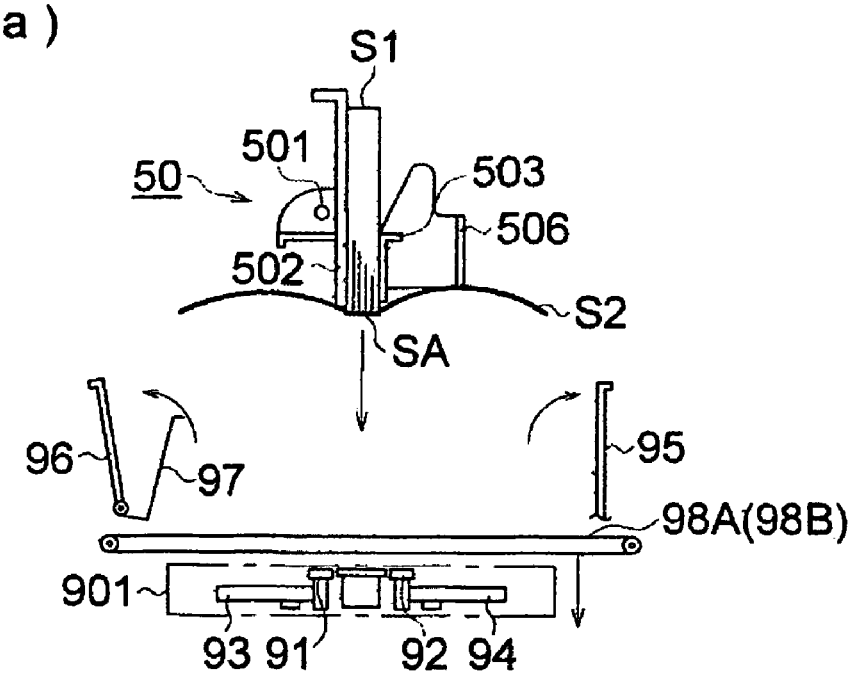
FIG. 12(*a*)-(*d*) show the procedures after the cover is attached.
Figure 12:
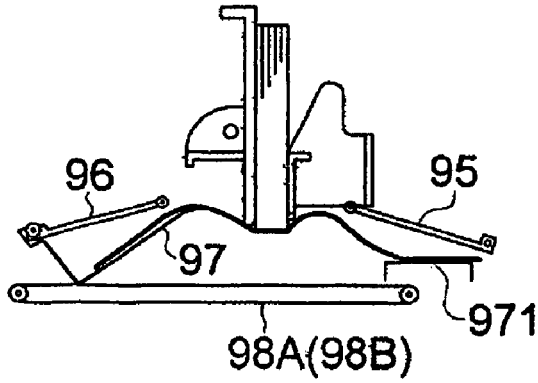
Figure 12:
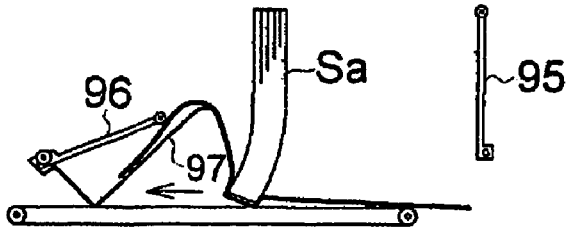
Figure 12:
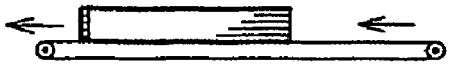

Referring to FIG. 12, the processing of cover S2 after cover S2 is attached is detailed.

After cover S2 is adhered, pressing members 91 and 92 are released, and cover supporting section 901 goes down about 100 mm driven by belts 99A and 99B, and returns to the home position, as shown in FIG. 12(*a*). In this case, in order to hold up covers S2 (being left and right covers) about 50 mm, cover holding members 95, 96 and 97 are turned from a vertical position to a horizontal position, and are again rotated counterclockwise, and cover lift-up member 971 also goes up.

Next, referring to FIGS. 8 and 9, belts 98A and 98B are driven to a position which is narrower than the width of cover S2, to raise cover supporting member 901 about 70 mm.

Further, holding plate 503 is shifted to a release position, and pressing force is released. Due to this, book S3, structured of stacked sheets S1 and cover S2, falls down onto belts 98A and 98B. Next, while cover supporting section 901 is again driven downward, belts 98A and 98B are rotated so that book S3 is brought down and is conveyed toward book ejecting section 100, see FIG. 1. In this case, as shown in FIG. 12(*c*), cover holding members 96 and 97 are rotated to the rising direction so that the left cover is lifted. When cover supporting section 901 arrives at the home position [see FIG. 12(*d*)], book S3 is conveyed toward the left by belts 98A and 98B, which is then ejected to book ejecting section 100.

Book ejecting plate 101 is raised or lowered by the belt drive. After book ejecting plate 101, on which book S3 is placed, is lowered, book S3 is shifted onto belt 102, and is conveyed by belt 102 to be ejected from the book-binding apparatus.

EXAMPLE

Using the book-binding apparatus, having the structure described above, the thickness of the book and the replenishing amount of the adhesive agent will be detailed.

Table 1 shows the relationship between the thickness of the book and the replenishing amount of the adhesive agent.

TABLE 1

| Thickness T | replenishing amount of solid adhesive agent |
|---|---|
| * Note 1 | 4 pieces |
| T ≦ 5 mm | 2 pieces |
| 5 mm < T < 10 mm | 4 pieces |
| 10 mm ≦ T < 10 mm | 8 pieces |
| 20 mm ≦ T < 30 mm | 12 pieces |
| 30 mm ≦ T < 40 mm | 16 pieces |
| 40 mm ≦ T | 20 pieces |

Note 1: When thickness information is not stored, a small amount of adhesive agent, such as 4 pieces, is replenished.

The weight of a piece of the adhesive agent is 0.5 g/piece.

The melting temperature of the adhesive agent is equal to or higher than 80° C., and the temperature for supplying the adhesive agent is determined to be equal to or lower than 160° C.

Figure 13:
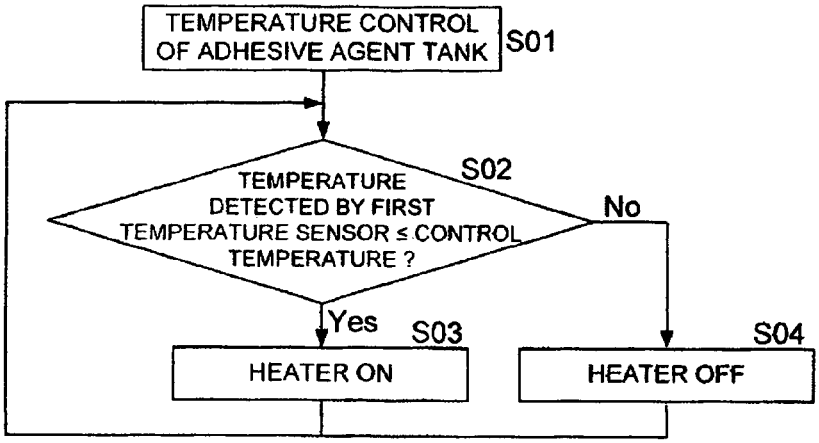
FIG. 13 is a flow chart of the temperature control of the adhesive agent tank, wherein the first temperature sensor and the first temperature control section are used.

FIG. 13 is a flow chart of the temperature control of adhesive agent tank, wherein the first temperature sensor and the first temperature control section are used.

After the temperature control is started (step S01), the first temperature sensor checks whether the adhesive agent temperature is in the control temperature (step S02). If it is lower than the control temperature, a heater is activated (step S03), while if it is higher than the control temperature, the heater is de-activated (step S04).

Figure 14:
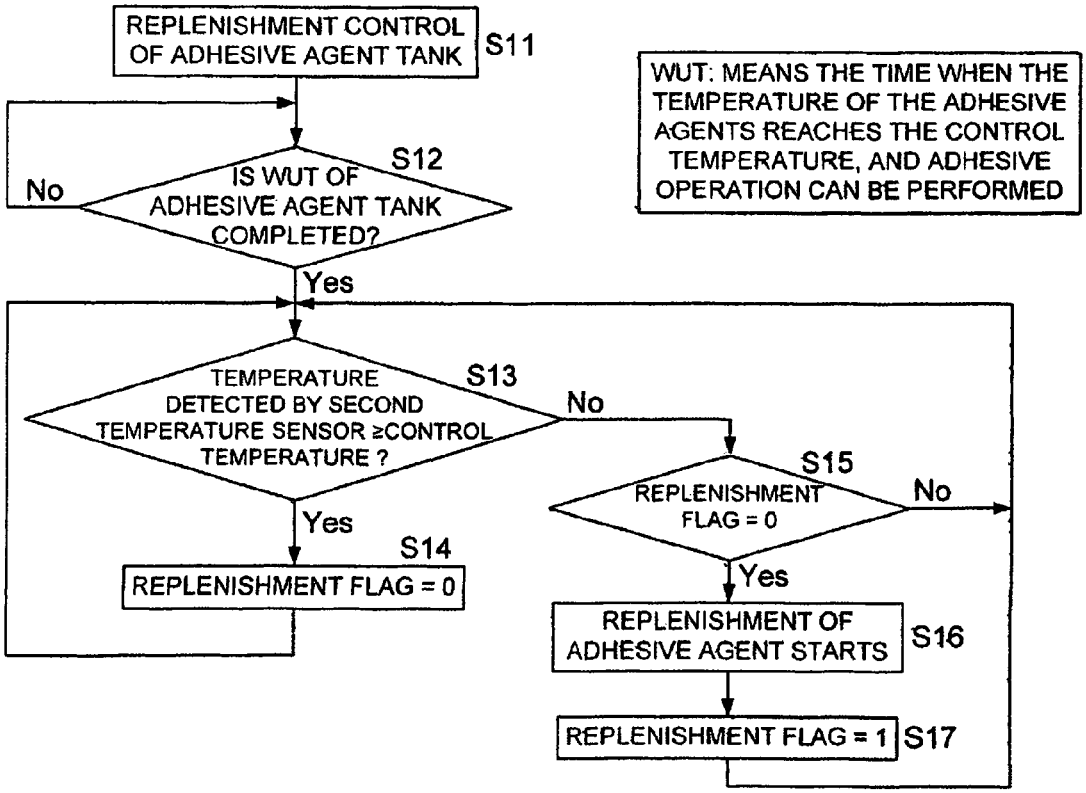
FIG. 14 is a flow chart of the replenishing control of the adhesive agent, wherein the second temperature sensor and the second temperature control section are used.

FIG. 14 is a flow chart of the replenishing control of the adhesive agent, wherein the second temperature sensor and the second temperature control section are used. In step S12 in FIG. 14, "WUT" means the time in which the temperature of the adhesive agent reaches the control temperature, and adhesive operation can be performed.

After the replenishing control of the adhesive agent is started (step S11), it is checked whether the warm-up time for the adhesive agent tank is completed or not (step S12), if the warm-up time is completed, the second temperature sensor measures whether the temperature of the adhesive agent is higher than the control temperature (step S13), and if it is higher than the control temperature, this condition is maintained (step S14), and if it is lower than the control temperature, determination is made whether replenishment is to be performed or not (step S15), wherein if replenishment is necessary, replenishment of the adhesive agent is performed (steps S16 and S17).

Figure 15:
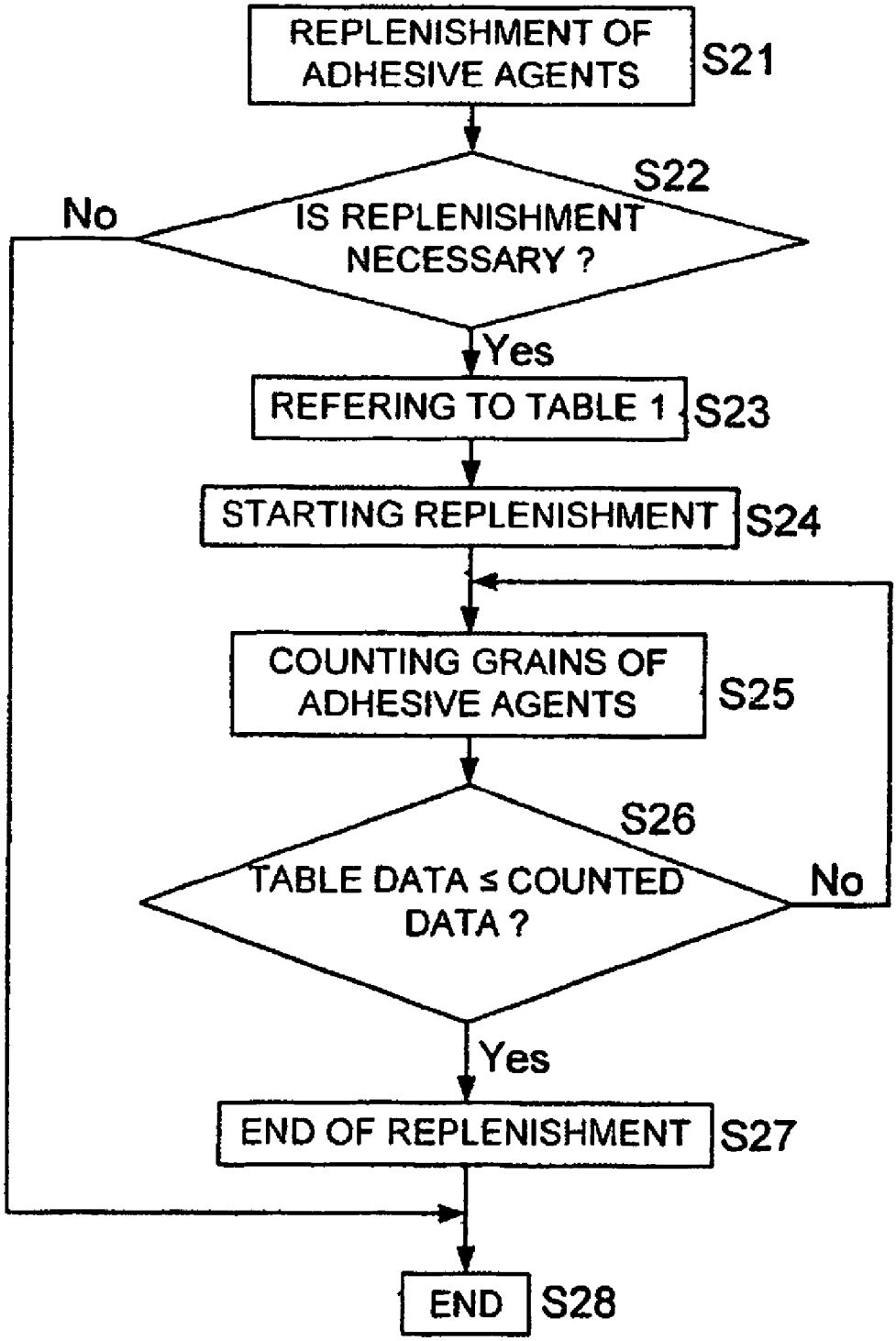
FIG. 15 is a flow chart of the replenishing control of the adhesive agent.

FIG. 15 is a flow chart of replenishment-control of the adhesive agent.

In a starting step of replenishment of the adhesive agent (step S21), it is checked whether replenishment of the adhesive agent is necessary or not (step S22), and if it is determined to be necessary, by a control section represented by CPU having therein data based on Table 1, the replenishment amount of the adhesive agent is determined referring to the thickness of the book (step S23). In step S24, replenishment operation is started based on the replenishing amount determined in step S23. When the pieces of the adhesive agent pass counter 70, the number of the pieces is counted (step S25), and it is checked whether the number of the pieces becomes the predetermined number (step S26), and when the number has become the predetermined number, replenishment is stopped (step S27), whereby, the operation is completed (step S28).

In the book-binding apparatus using the adhesive agent of the present invention, which includes the above control method, though books of differing thickness are bound, the predetermined amount of the adhesive agent is replenished into the adhesive agent tank, and thereby the book-binding can be stably performed.

As described in Structures 1 and 2, it is possible to control the melting temperature of the adhesive agent, and replenish the agent by a quite simple structure.

Further, since the replenishment amount of the adhesive agent is controlled based on the thickness of the book, it is possible to keep the amount of the adhesive agent in the tank at a constant level.

Since the detecting section of the amount of the adhesive agent counts the pieces which pass the supplying path, the replenishment amount is precisely controlled.

Further, for another detecting section of the amount of the adhesive agent, a batch processing section may be used, which can also control the replenishment amount by a quite simple structure.

Still further, since the vibrator is provided midstream of the conveyance path, the adhesive agent tends not to clog the conveyance path.

Further, while the preferred embodiments of the present invention have been described using specific term, such description is for illustrative purpose only, and it is to be understood that changes and variations may be made without departing from the spirit and scope of the appended claims.

What is claimed is:

1. A book-binding apparatus in which adhesive agent is used for binding a book, comprising:

an adhesive agent tank to store an adhesive agent which is heat-melted;

a heating section to heat the adhesive agent in the adhesive agent tank;

a coating section to coat the melted adhesive agent on a spine of the book;

a first temperature sensor mounted in the adhesive agent tank to detect a temperature of the melted adhesive agent;

a first control section to control the heating section based on a temperature detection signal which has been detected by the first temperature sensor, wherein the first control section controls the heating section so as to make the temperature of the melted adhesive agent in the adhesive agent tank become a predetermined temperature;

a second temperature sensor mounted at a position adjacent to a top level of the melted adhesive agent;

an adhesive agent transporting section to transport a solid adhesive agent into the adhesive agent tank;

a thickness detecting section to detect a thickness of the book to be bound;

a memory section to store a table to show relationship between the thickness of the book and the amount of the solid adhesive agent to be transported into the adhesive agent tank;

a determining section to determine the amount of the solid adhesive agent to be transported to the adhesive agent tank based on both information of the thickness of the book detected by the thickness detecting section and information of the table stored in the memory section; and a second control section to control the adhesive agent transporting section so as to transport the solid adhesive agent to the adhesive agent tank, the amount of the solid adhesive agent being determined by the determining section, when the temperature of the melted adhesive agent detected by the second temperature sensor is equal to or lower than a set temperature.

2. The book-binding apparatus in claim 1, further comprising:

a replenishment amount detecting section which detects the amount of the adhesive agent to be transported to the adhesive agent tank.

3. The book-binding apparatus in claim 2, wherein the replenishment amount detecting section detects the replenishment amount by counting the number of solid pieces of the adhesive agent.

4. The book-binding apparatus in claim 2, wherein when the replenishment amount detecting section has detected a predetermined weight of the solid pieces, replenishment is performed.

5. The book-binding apparatus in claim 2, wherein when the replenishment amount detecting section has detected a predetermined volume, replenishment is performed.

6. The book-binding apparatus in claim 1, wherein the second temperature sensor is mounted at a position which comes into contact with the top level of the adhesive agent in the adhesive agent tank, when the amount of the adhesive agent in the adhesive agent tank is the greatest.

7. The book-binding apparatus in claim 1, wherein the second temperature sensor is mounted at a position which is separated from the top level of the adhesive agent in the adhesive agent tank, when the amount of the adhesive agent in the adhesive agent tank is the greatest.

8. The book-binding apparatus in claim 1, wherein the second temperature sensor is mounted at a position which is under the top level of the adhesive agent in the adhesive agent tank, when the amount of the adhesive agent in the adhesive agent tank is the greatest.

9. The book-binding apparatus in claim 1, wherein the thickness of the book is a thickness of the book which was bound before the adhesive agent is transported and replenished to the adhesive agent tank.

10. The book-binding apparatus in claim 1, wherein the adhesive agent transporting section includes a vibrating section which vibrates the adhesive agent with a predetermined vibration while the adhesive agent is transported.

11. A book-binding apparatus, comprising:

an adhesive agent tank to store an adhesive agent which is heat-melted;

a heating section to heat the adhesive agent in the adhesive agent tank;

a coating section to coat the melted adhesive agent on a spine of a book;

a temperature sensor mounted at a position adjacent to a top level of the melted adhesive agent;

an adhesive agent transporting section to transport a solid adhesive agent to the adhesive agent tank;

a thickness detecting section to detect a thickness of the book to be bound;

a memory section to store a table to show relationship between the thickness of the book and the amount of the solid adhesive agent to be transported into the adhesive agent tank;

a determining section to determine the amount of the solid adhesive agent to be replenished transported to the adhesive agent tank based on both the information of the thickness of the book detected by the thickness detecting section and information of the table stored in the memory section; and a control section to control the adhesive agent transporting section so as to transport the solid adhesive agent to the adhesive agent tank, the amount of the solid adhesive agent being determined by the determining section, when the temperature of the melted adhesive agent detected by the temperature sensor is equal to or lower than a set temperature.

12. The book-binding apparatus in claim 11, further comprising:

a replenishment amount detecting section which detects an amount of the adhesive agent to be transported.

13. The book-binding apparatus in claim 11, wherein the second temperature sensor is mounted at a position which comes into contact with the top level of the adhesive agent in the adhesive agent tank, when the amount of the adhesive agent in the adhesive agent tank is the greatest.

14. The book-binding apparatus in claim 11, wherein the second temperature sensor is mounted at a position which is separated from the top level of the adhesive agent in the adhesive agent tank, when the amount of the adhesive agent in the adhesive agent tank is the greatest.

15. The book-binding apparatus in claim 11, wherein the second temperature sensor is mounted at a position which is under the top level of the adhesive agent in the adhesive agent tank, when the amount of the adhesive agent in the adhesive agent tank is the greatest.

16. The book-binding apparatus in claim 11, wherein the thickness of the book is a thickness of a book which was bound before the adhesive agent is replenished to the adhesive agent tank.

17. The book-binding apparatus in claim 11, wherein the adhesive agent transporting section includes a vibrating section which vibrates the adhesive agent with a predetermined vibration while the adhesive agent is transported.

* * * * *